US008899226B2

(12) United States Patent
Blalock

(10) Patent No.: US 8,899,226 B2
(45) Date of Patent: Dec. 2, 2014

(54) APPARATUS FOR DRAWING A CRYOGENIC LIQUID FROM A CONTAINER

(75) Inventor: Clayton E. Blalock, New Smyrna Beach, FL (US)

(73) Assignee: BCS Life Support, LLC, Titusville, FL (US)

( * ) Notice: Subject to any disclaimer, the term of this patent is extended or adjusted under 35 U.S.C. 154(b) by 980 days.

(21) Appl. No.: 11/673,046

(22) Filed: Feb. 9, 2007

(65) Prior Publication Data

US 2007/0186925 A1 Aug. 16, 2007

Related U.S. Application Data

(60) Provisional application No. 60/773,468, filed on Feb. 14, 2006.

(51) Int. Cl.

| | |
|---|---|
| ***A62B 7/06*** | (2006.01) |
| ***F17C 3/08*** | (2006.01) |
| ***F17C 6/00*** | (2006.01) |
| ***F17C 9/02*** | (2006.01) |

(52) U.S. Cl.

CPC ... *A62B 7/06* (2013.01); *F17C 3/08* (2013.01); *F17C 6/00* (2013.01); *F17C 9/02* (2013.01); *F17C 2201/0104* (2013.01); *F17C 2201/032* (2013.01); *F17C 2201/035* (2013.01); *F17C 2201/037* (2013.01); *F17C 2201/058* (2013.01); *F17C 2203/0391* (2013.01); *F17C 2203/0629* (2013.01); *F17C 2205/0352* (2013.01); *F17C 2205/0361* (2013.01); *F17C 2205/0364* (2013.01); *F17C 2221/031* (2013.01); *F17C 2223/0161* (2013.01); *F17C 2223/033* (2013.01); *F17C 2223/047* (2013.01); *F17C 2225/0123* (2013.01); *F17C 2225/033* (2013.01); *F17C 2227/0107* (2013.01); *F17C 2227/0302* (2013.01); *F17C 2227/0388* (2013.01); *F17C 2227/0393* (2013.01); *F17C 2260/035* (2013.01); *F17C 2270/025* (2013.01); *Y10S 128/27* (2013.01)

USPC ..... 128/201.21; 128/DIG. 27

(58) Field of Classification Search

CPC ..... A62B 7/00; A62B 7/06; A62B 9/04; F17C 1/00; F17C 1/005; F17C 7/00; F17C 7/02; F17C 7/04; F17C 9/00; F17C 9/02; F17C 9/04; F17C 13/001; F17C 13/002; F17C 13/005; F17C 13/006; A61M 16/10; A61M 2202/03; F25J 2215/40; B67D 1/0456; B67D 3/0048; B67D 7/007

USPC ..... 128/200.24, 201.21, 204.17, 201.27; 62/45.1, 50.2; 137/577, 590

See application file for complete search history.

(56) References Cited

U.S. PATENT DOCUMENTS

| | | | | |
|---|---|---|---|---|
| 3,318,307 | A * | 5/1967 | Nicastro | 128/201.21 |
| 3,570,481 | A | 3/1971 | Woodberry, Jr | |
| 3,572,048 | A * | 3/1971 | Murphy | 62/50.2 |
| 4,181,126 | A * | 1/1980 | Hendry | 128/201.21 |
| 4,854,388 | A * | 8/1989 | Wyatt | 169/26 |
| 4,909,038 | A | 3/1990 | Porter | |

(Continued)

*Primary Examiner* — Justine Yu
*Assistant Examiner* — Colin W Stuart

(57) ABSTRACT

An apparatus or system is provided for withdrawing a cryogenic liquid from a container. The liquid may be drawn from the container independent of the orientation of the container. The apparatus includes a conduit having a flexible metallic hose portion and a metallic head. The flexible hose portion has a first end in fluid communication with an outlet portal of the container and a second end to which the head is attached.

10 Claims, 5 Drawing Sheets

(56) References Cited

U.S. PATENT DOCUMENTS

| | | | | | |
|---|---|---|---|---|---|
| 5,004,536 | A | * | 4/1991 | Geisler | 210/136 |
| 5,195,664 | A | * | 3/1993 | Rhea | 222/464.4 |
| 5,353,835 | A | * | 10/1994 | Mills | 137/590 |
| 5,357,758 | A | * | 10/1994 | Andonian | 62/45.1 |
| 5,689,968 | A | * | 11/1997 | Frustaci et al. | 62/259.3 |
| 5,987,896 | A | * | 11/1999 | James et al. | 62/48.3 |
| RE36,460 | E | * | 12/1999 | Klatz et al. | 604/26 |
| 6,012,453 | A | | 1/2000 | Tsals et al. | |
| 6,089,226 | A | * | 7/2000 | Gier | 128/201.21 |
| 6,264,073 | B1 | * | 7/2001 | Good et al. | 222/464.4 |
| 6,393,846 | B1 | | 5/2002 | Frye | |
| 6,513,336 | B2 | * | 2/2003 | Zurecki et al. | 62/50.7 |
| 6,575,159 | B1 | | 6/2003 | Frye et al. | |
| 6,833,072 | B1 | * | 12/2004 | Krestine et al. | 210/416.1 |
| 7,464,557 | B2 | * | 12/2008 | Vandor et al. | 62/50.2 |
| 2003/0089744 | A1 | * | 5/2003 | Mandile | 222/464.3 |
| 2005/0247308 | A1 | * | 11/2005 | Frye et al. | 128/200.24 |

* cited by examiner

APPARATUS FOR DRAWING A CRYOGENIC LIQUID FROM A CONTAINER

CROSS-REFERENCE TO RELATED APPLICATIONS

This application claims priority based on Provisional Application No. 60/773,468 filed Feb. 14, 2006.

BACKGROUND OF THE INVENTION

An embodiment of the invention pertains to devices used to store liquids in a container and devices used to withdraw liquids from the container. More specifically, the invention pertains to devices used to withdraw a liquid from a container independent of the orientation of the container.

In instances where the withdrawal of a liquid from a container is regulated or the liquid is selectively drawn from the container, the liquid is typically drawn from a bottom of the container. By way of example, some self-contained breathing apparatuses ("SCBA") include a tank in which cryogenic liquid air is stored. The tank typically has an outlet portal or tube disposed at a bottom of the tank in order to capture as much of the liquid as possible during use. If an exit portal or end of a tube leading to an exit portal is disposed at some point above the bottom of the tank, the liquid can not be effectively withdrawn from the tank if the level of the liquid drops below the exit portal.

When the tank of the SCBA is disposed in an upright position, the liquid may be effectively drawn from the tank. However, in some instances the tank may be reoriented as when a user bends over. In such cases, if the liquid level is too low, the liquid cannot be effectively drawn from the tank and the SCBA may cease to function. Accordingly, a need exists for a system, apparatus or method that draws a liquid, stored in a container, that operates independent of the orientation of the container.

SUMMARY OF THE INVENTION

An embodiment of the invention comprises an apparatus or system for withdrawing a cryogenic liquid from a container wherein the liquid may be drawn from the container independent of the orientation of the container. The apparatus comprises a conduit having a flexible metallic hose portion and a metallic head. The flexible hose portion has a first end in fluid communication with an outlet portal of the container and a second end to which the head is attached. The hose portion and head are preferably fabricated from a metal alloy that is capable of withstanding the extreme temperatures associated with storing cryogenic liquids. In addition, the hose portion has a corrugated configuration so it is flexible enough to allow the head to follow an inner contour of the container when the container is tilted or reoriented in order to continue to draw the liquid from the container.

DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

While embodiments of the invention are described in the context of the below-described SCBA 10, it should be understand that the present invention may by used, or incorporated, with any tank, vessel or container used to store a liquid so the liquid can be drawn from the container independent of the orientation of the container.

Figure 1:
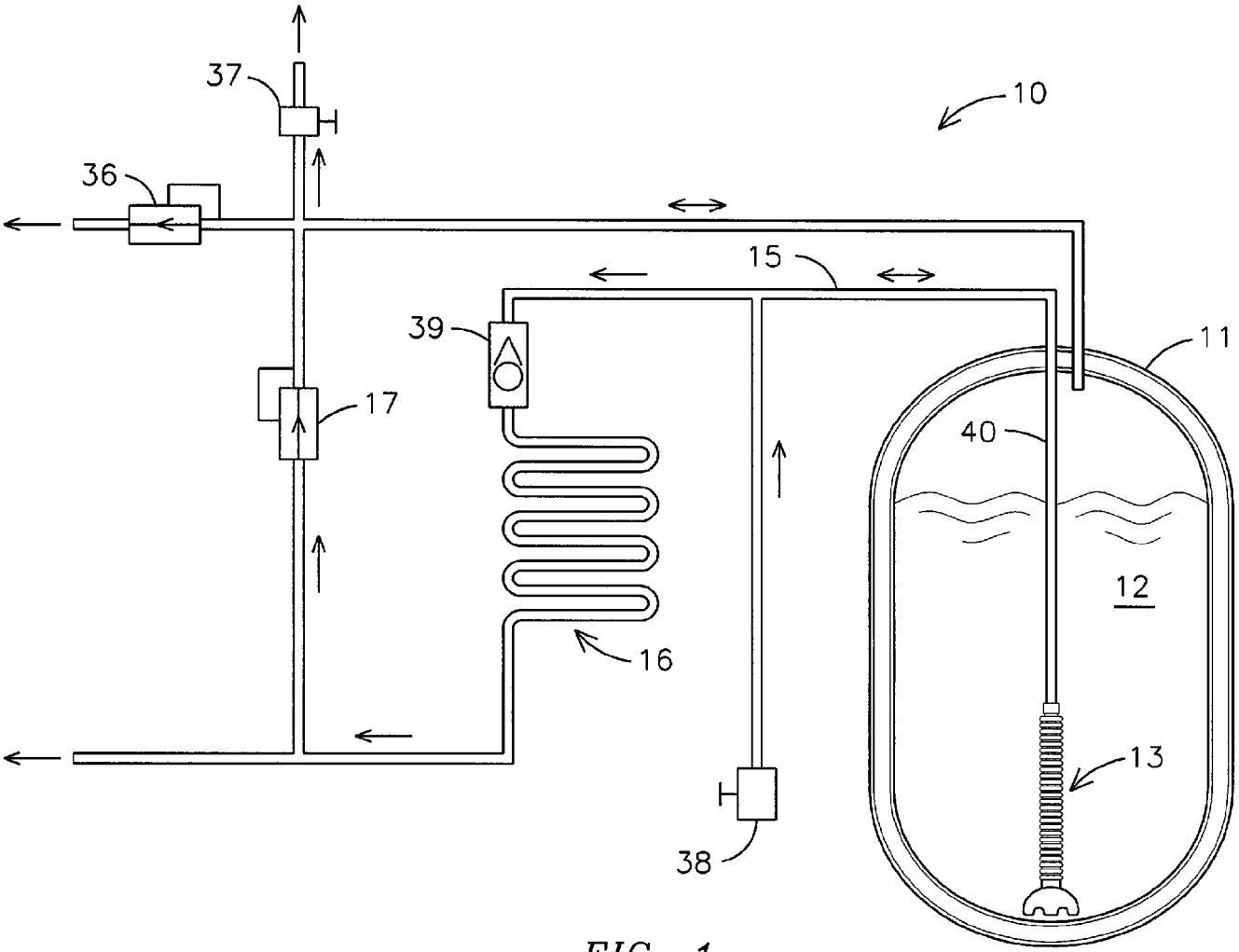
FIG. 1 is a schematic view of an SCBA with a flexible conduit mounted in the interior of the tank.

With respect to FIG. 1 there is shown an embodiment of the invention incorporated with a closed circuit SCBA unit 10 having a tank 11 within which cryogenic liquid air 12 is stored. A flexible conduit 13 is mounted in the interior of the tank 11 in fluid communication with an outlet portal 14 and line 15. The tank 11 is filled with a liquid 12 such as cryogenic liquid air stored under pressure at about thirty to one hundred pounds per square inch. The pressure within the tank 11 is maintained or controlled by a pressure regulator 17, relief valve 36 and vent valve 37. The liquid 12 may be supplied into the tank via a fill valve 38.

The liquid air 12 flows from the tank 11 through the conduit 13, outlet portal 14 and line 15, past a check valve 39 and to a heat exchanger 16. The heat exchanger 16 vaporizes the liquid air 12 creating breathable air, which a user draws through a mask (not shown). Some of the breathable air is bypassed through the regulator 17 and into a ullage space within the tank 11; thereby, completing the pressurized closed circuit.

Figure 2:
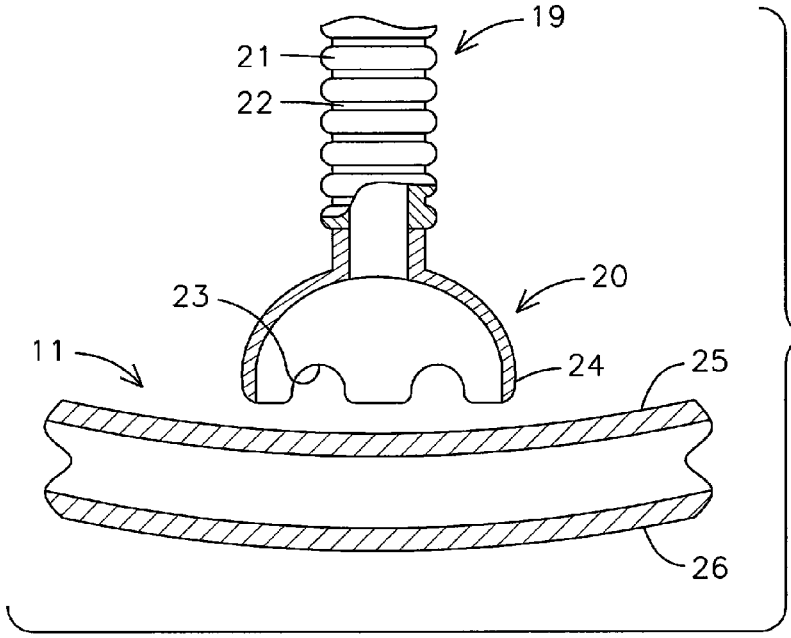
FIG. 2 is an elevational and partial sectional view of the conduit in FIG. 1.
Figure 3:
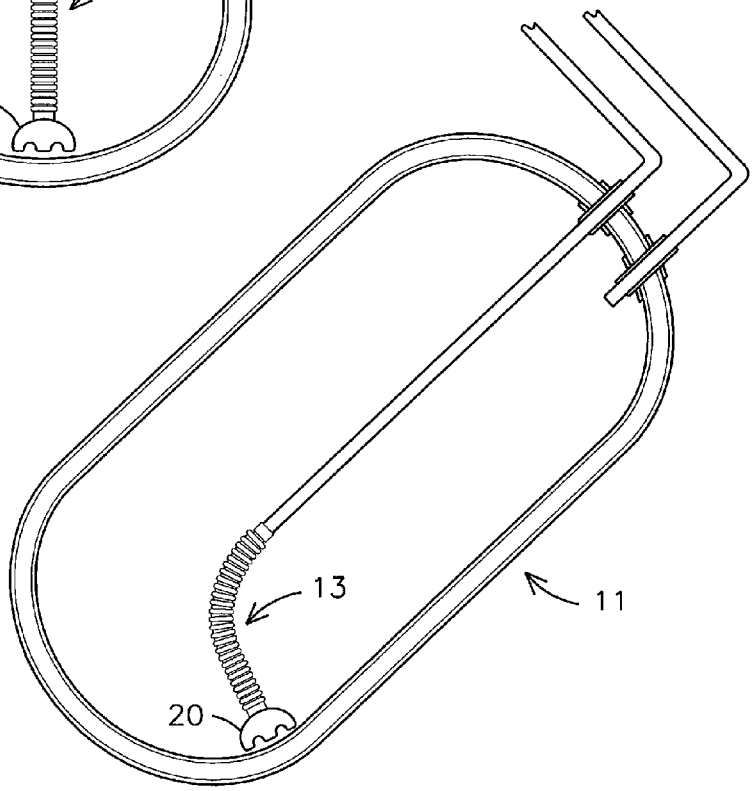
FIG. 3 is a view of the tank in a tilted position.

The conduit 13, shown in more detail in FIG. 2, includes a flexible hose portion 19 and a head 20. As shown in FIGS. 1 and 3, when the tank 11 is reoriented from an upright position, the head 20 is weighted so it will travel along an interior wall of the tank 11 following the direction of orientation of the tank and flow of liquid air. In this manner, the conduit 13 remains in fluid communication with the liquid air 12 and continues to draw the liquid air 12 from the tank 11 despite the reorientation of the tank 11.

At least with respect to use of the conduit 13 with liquid air 12, the hose portion 19 and the head 20 are fabricated from a metallic material to withstand the extreme cold temperatures within the tank 11. Liquid air may be stored at temperatures ranging from about −290° F. to about −318° F. depending on the pressure within the tank 11. By way of example, the hose portion 19 and head 20 may be fabricated from a stainless steel alloy or a nickel based alloy or such as Inconel® or Hastelloy®.

If fabricated from a metal alloy as, and in order to achieve sufficient flexibility, the hose portion 19 may have the convoluted or corrugated configuration shown in FIG. 2. As illustrated, the hose portion 20 consists of a first set of sections 21 having a larger diameter than, and integrally connected to a second set of sections 22. The hose 19 may be configured so that each second section 22 is disposed between consecutive first sections 21, or vice versa. In addition, the walls of the sections 21 and 22 may be about 5/1000 of an inch thick to achieve sufficient flexibility of the hose portion 19.

The length of the hose portion 19 may vary depending on the size of the tank 11, but it should be long enough so that head 20 remains at least partially submersed in the liquid 12 when the tank 11 is reoriented from an upright position to a substantially horizontal position. By way of example, for a tank 11 that is about fourteen inches long having an inside diameter of about 6" to about 6½" and an outside diameter of about 8", the hose portion may be about 6" long.

Figure 4:
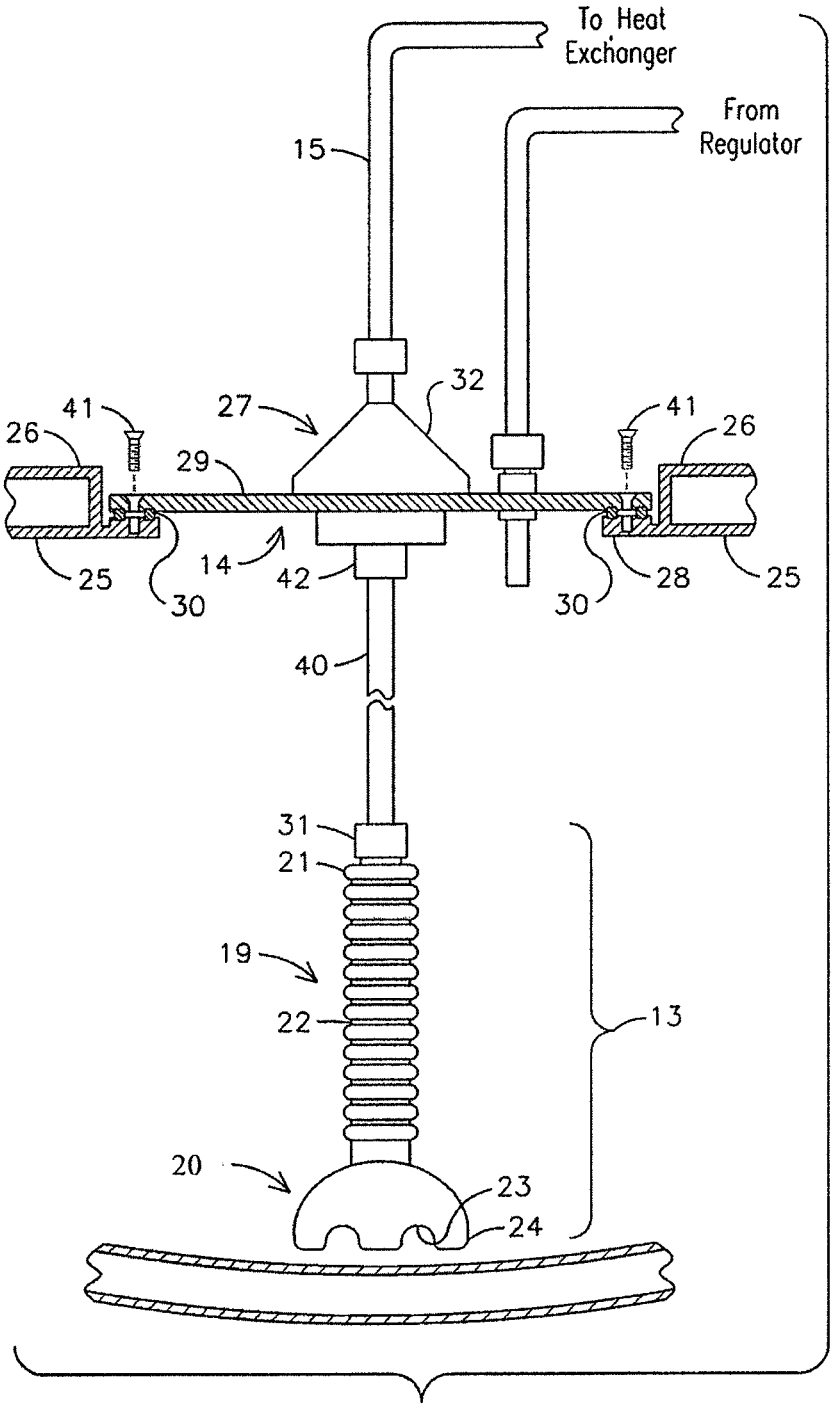
FIG. 4 is a sectional view of the tank of the SCBA in FIG. 1 illustrating the attachment of the conduit to the tank.

As shown in FIGS. 2 and 4, the head 20 has a plurality of notches 23 disposed between consecutive projections 24. The head 20 may be integrally attached to a bottom first section 21 or second section 22 of the hose 19, or other means for attachment such as weld or threaded attachments may suffice. With a tank 11 and hose portion 19 having the above-described dimensions, the head 20 may have an inside diameter of about one quarter of an inch.

Figure 7:
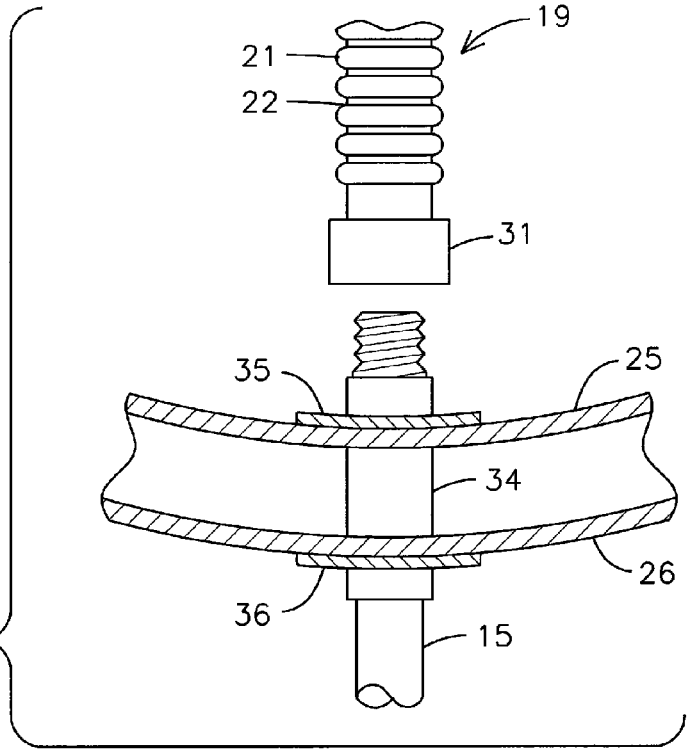
FIG. 7 is a detail of an attachment of the conduit to the tank.
Figure 5:
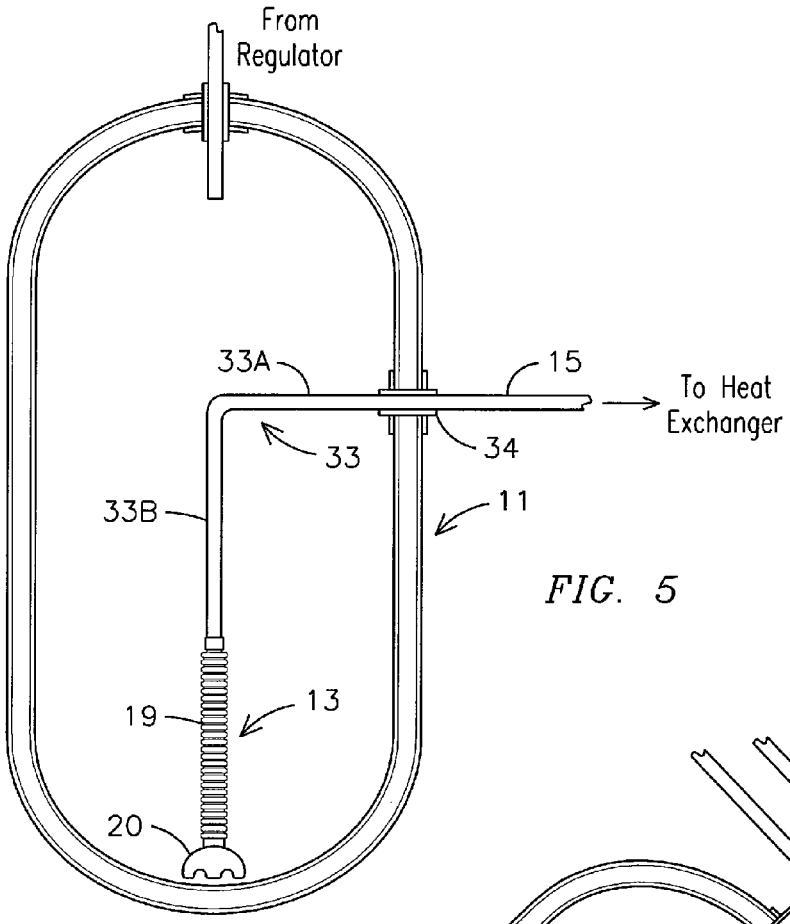
FIG. 5 is an embodiment of the invention with the conduit connected to a tube that enters the tank at a point above the bottom of the tank.

With respect to FIGS. 4 and 7, means for mounting the conduit 13 to the tank 11 is illustrated. In an embodiment, the mounting means may include the fixture 27 shown in FIG. 4. The tank 11 is vacuum insulated including an inner wall 25 and outer wall 26 spaced from the inner wall 25 with a vacuum created there between. A mounting fixture 27 is secured in sealing relationship to a flange 28 protruding from the inner wall 25 and circumferentially extending around the outlet portal 14. The mounting fixture 27 includes a flange 29 that is secured to the flange 28 by bolts 41, and o-rings 30 disposed between the flanges 28 and 29 seal the interior of the tank 11.

The fitting 31 mounted to the hose portion 19 distal the head 20 of the conduit 13 is secured to an end of an interior tube 40. The tube 40 is secured by fitting 42 to the flange 29. An adapter 32 is affixed to the flange 29 of the fixture 27 for receiving the line 15, placing the conduit 13 and interior of the tank 11 in fluid communication with the line 15.

Figure 6:
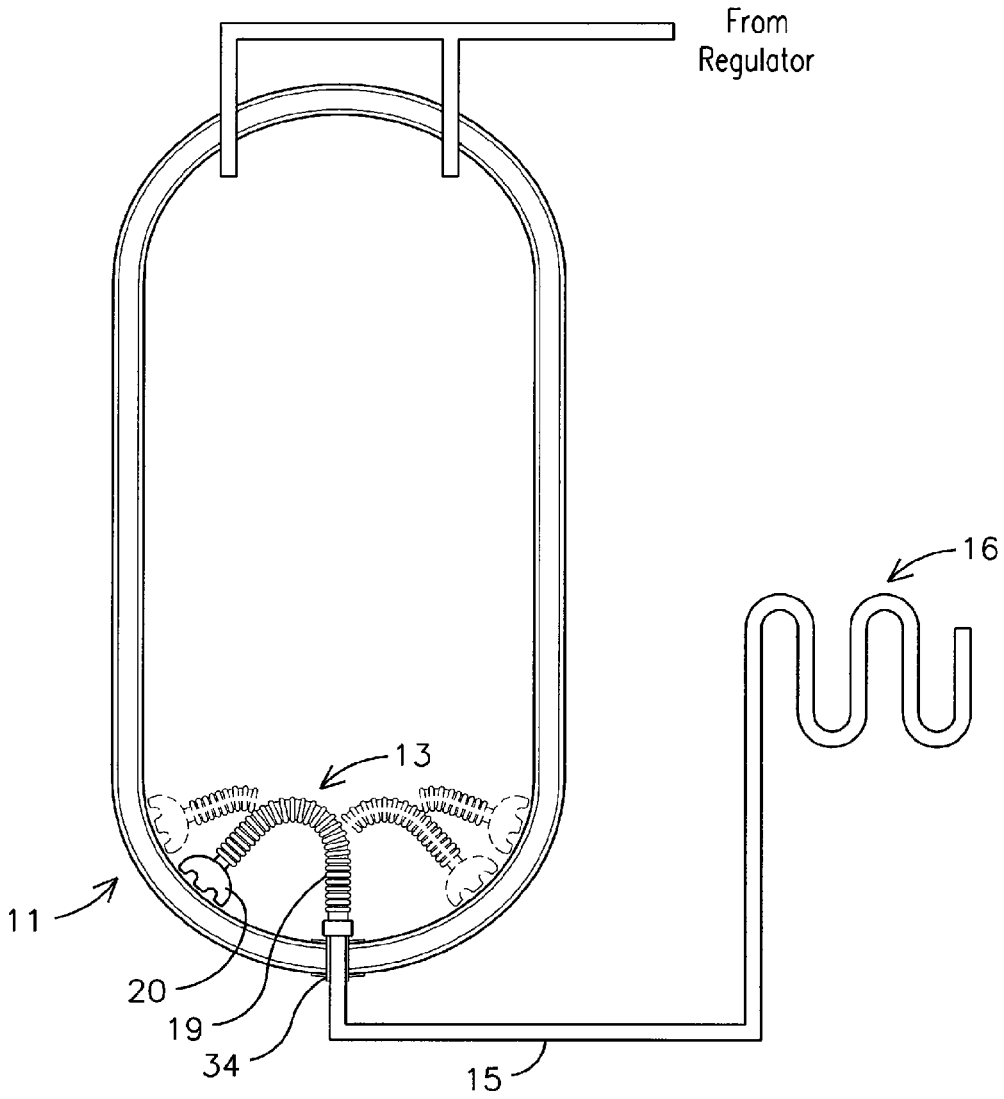
FIG. 6 is an embodiment of the invention with the conduit mounted to a bottom of the tank.

In another embodiment shown in FIG. 7, the fitting 31 on the hose portion 19 secures the conduit to an adaptor 34 that has been inserted through the outlet portal 14 (not shown). The adaptor 34 is attached to line 15, placing the line 15 in fluid communication with the conduit 13 and an interior of the tank. In addition, o-rings 35 are positioned in the interior and exterior of the tank and seated between the adaptor 34 and the tank 11 to seal the interior of the tank 11. Such an assembly may be advantageous when the outlet portal 14 is disposed on the bottom of the tank 11 as shown in FIG. 6.

In the embodiment shown in FIG. 1, the outlet portal 14 is disposed at a top of the tank 11; however, the outlet portal 14 may be located at different points on the tank. As shown in FIG. 7, the exit portal 14 is positioned on a side of the tank 11 approximately half way between the top and bottom of the tank 11. In this embodiment, a tube 33 is attached to the adaptor 34, or otherwise appropriately mounted to the tank 11, and the conduit 13 is mounted to the tube 33. The tube L-shaped having a first section 33A extending laterally with respect to a side of the tank 11, and a second section 33B depending from the first section 33A and connected to the conduit 13.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. An apparatus for withdrawing a cryogenic liquid air from a container having an inner volume, wherein the inner volume is in fluid communication with a heat exchanger exterior of the container and through which the cryogenic liquid air flows for vaporization into breathable air, comprising:

a conduit having a rigid tube portion extending into the inner volume of the container and having a flexible metallic hose portion with a first end attached to an end of the rigid tube portion disposed within the inner volume of the container and a metallic weighted head attached to a second end of the flexible metallic hose portion; and, wherein the rigid tube portion and flexible hose portion are in fluid communication with the inner volume of the container and the heat exchanger for drawing the liquid air from the container to the heat exchanger, and the container having a concave semi-spherical bottom end in the inner volume and the first end of the flexible hose portion being attached to the rigid tube portion a predetermined distance from the bottom end of the container forming a pivot area at a junction of the rigid tube portion and flexible hose portion so the weighted head follows a contour of the concave semi-spherical bottom end of the container without coming into contact with the concave semi-spherical bottom end to draw liquid air from the container independent of an orientation of the container.

2. The apparatus of claim 1 wherein the head has an opening and a plurality of projections are disposed circumferentially around the opening and a plurality of notches are on the head with each notch disposed between consecutive projections for drawing the liquid air through the opening of the head.

3. The apparatus of claim 1 wherein an outlet portal is disposed on a top of the container and the rigid tube portion has a first end mounted to the container in fluid communication with the outlet portal and a second end that is mounted to the flexible hose portion.

4. The apparatus of claim 1 wherein an outlet portal is disposed on a side of the container and the rigid tube portion has a first end mounted to the container in fluid communication with the outlet portal, and the rigid tube portion has a first section extending laterally from the side of the container and a second section attached to the first section depending therefrom and connected to the flexible hose portion.

5. The apparatus of claim 1 wherein the cryogenic liquid air in the container is stored at temperatures ranging from about −290° F. to about −318° F. and the flexible hose portion is composed of a nickel based alloy.

6. A self-contained breathing apparatus having a supply of cryogenic liquid air, comprising:

a container within which a supply of cryogenic liquid air is held;

a regulator for controlling pressure within the container;

an outlet portal on the container through which the cryogenic liquid air is drawn;

a heat exchanger in fluid communication with the outlet portal and an interior of the container; and a conduit disposed within the container and in fluid communication with the interior of the container, the outlet portal and the heat exchanger;

wherein:

breathing air is created by the liquid air traveling from the container through the heat exchanger; and the conduit comprises a metallic flexible hose portion having a first end connected to a rigid tube portion, at least a portion of the rigid tube portion being disposed within an inner volume of the container and is in fluid communication with the outlet portal and heat exchanger, and a second end having a weighted head mounted thereon distal the first end; and the first end of the flexible hose portion connected to the rigid tube portion forms a junction between the rigid tube portion and flexible hose portion at a predetermined distance from a semi-spherical bottom end of the container and at which the flexible hose portion pivots relative to the rigid tube portion so the weighted head follows a contour of the semi-spherical bottom end of the container without coming into contact with the semi-spherical bottom end to draw cryogenic liquid air from the container independent of an orientation of the container.

7. The self-contained breathing apparatus of claim 6 wherein the head has an opening and a plurality of projections are disposed circumferentially around the opening and a plurality of notches are on the head with each notch disposed between consecutive projections for drawing the liquid air through the opening of the head.

8. The self-contained breathing apparatus of claim 6 wherein the outlet portal is disposed on a top of the container and the rigid tube portion has a first end mounted to the container in fluid communication with the outlet portal and a second end that is mounted to the flexible hose portion.

9. The self-contained breathing apparatus of claim 6 wherein the outlet portal is disposed on a side of the container and the rigid tube portion has a first end mounted to the container in fluid communication with the outlet portal and a second end that is mounted to the flexible hose portion, and the rigid tube portion has a first section extending laterally from the side of the container and a second section attached to the first section depending there from and connected to the flexible hose portion.

10. The self-contained breathing apparatus of claim 6 wherein the cryogenic liquid air in the container is stored at temperatures ranging from about −290° F. to about −318° F. and the flexible hose portion is composed of a nickel based alloy.

* * * * *